United States Patent [19]

Niinuma et al.

[11] Patent Number: 4,827,087

[45] Date of Patent: May 2, 1989

[54] PUSH BUTTON SWITCH

[75] Inventors: Akira Niinuma; Hidenori Nagai, both of Furukawa, Japan

[73] Assignee: Alps Electric Co., Ltd., Japan

[21] Appl. No.: 173,720

[22] Filed: Mar. 25, 1988

[30] Foreign Application Priority Data

Jun. 1, 1987 [JP] Japan ..... 62-83187[U]

[51] Int. Cl.[4] ..... H01H 9/26

[52] U.S. Cl. ..... 200/5 E; 200/50 C; 200/523

[58] Field of Search ..... 200/5 R, 5 B, 5 E, 5 EA, 200/5 EB, 50 C, 153 J, 159 R, 328; 74/483 R, 483 PB

[56] References Cited

U.S. PATENT DOCUMENTS

| | | | |
|---|---|---|---|
| 4,392,029 | 7/1983 | Schaad et al. | 200/5 B |
| 4,584,897 | 4/1986 | Sharp, Jr. | 74/483 PB |
| 4,636,601 | 1/1987 | Tanabe | 200/153 J |

*Primary Examiner*—J. R. Scott

*Attorney, Agent, or Firm*—Guy W. Shoup; Paul J. Winters; Stephen L. Malaska

[57] ABSTRACT

A push button switch with a simultaneous locking preventing function which can attain its miniaturization while realizing a sure single action. The switch includes a core mounted for sliding movement in each of a pair of sliders mounted for up and down movement in a casing. A heart-shaped cam groove having a plurality of regions of varying height is formed either on an end face of each core or with the locking region of the cam groove formed on an end face of each core and with the remaining regions formed on a contiguous wall face of the corresponding slider. An actuator pin is provided for each slider and traces the cam groove to lock the slider at its depressed position when the slider is depressed. When the sliders are depressed simultaneously, a simultaneous locking preventing member prevents the sliders from being locked at the depressed positions. The simultaneous locking preventing member has a pair of cam faces formed at opposite ends thereof for moving, when one of the sliders is depressed, the core corresponding to the other slider so that the corresponding actuator pin is released from locking by the corresponding heart-shaped cam groove to allow the other slider to be returned to the home position, making an interlocking action.

6 Claims, 4 Drawing Sheets

PUSH BUTTON SWITCH

BACKGROUND OF THE INVENTION

This invention relates to a push button switch, and more particular to a push button switch of the interlocking/single-acting type with a simultaneous locking preventing function wherein, when one of a pair of juxtaposed sliders is in a non-locked condition, the other slider makes a single action wherein it is alternately locked and released by depressing operations thereof, but when one of the sliders is in a locked condition, the other slider itself is brought into a locked condition and releases the one slider from its locked condition thereby making an interlocking action, and when the two sliders are depressed at the same time, they are prevented from being locked simultaneously.

A switch of such an interlocking/single-acting type normally includes a push lock mechanism which is constituted from a cam groove having a heart-like configuration and an actuator pin for tracing the cam groove. For example, a push button switch disclosed in Japanese Patent Laid-Open No. 61-47027 includes a pair of actuator pins each supported for rocking motion on a slider, and a cam plate supported for rotation on an inner wall of a casing and having a pair of heart-shaped cam grooves formed thereon, whereby the cam plates are each rotated by the corresponding actuator pin. Accordingly, if one of the sliders is depressed, the driving pin thereon traces the corresponding cam groove, making a single action of the two sliders. On the other hand, if one of the sliders is depressed when the other slider is in a locked condition, the actuator pin on the depressed slider is locked while the cam plate is rotated by the actuator pin to release the other slider from its locked condition, making an interlocking action of the two sliders.

Meanwhile, in case a simultaneous locking preventing function is required for such an interlocking/single-acting switch, normally a simultaneous locking preventing plate is located between two sliders for movement in a direction perpendicular to the direction of reciprocal movement of the sliders so that it may prevent simultaneous locking of the sliders though this is not disclosed in Japanese Patent Laid-Open No. 61-47027 mentioned above. In the arrangement, upon single action by depression of only one of the two sliders, the simultaneous locking preventing plate is pushed by the one slider to move toward the other slider, but otherwise when the two sliders are depressed at the same time, opposite ends of the simultaneous locking preventing plate are abutted with the sliders at the same time thereby to prevent further movement of the sliders and thus prevent simultaneous switching of two circuits.

However, with the push button switch having such a construction as described above, since a locked condition of the actuator pin by the cam groove is released by rotation of the cam plate, there is the possibility that, upon such releasing, a locking step or shoulder of the cam groove may be abutted hard with an end of the actuator pin and the cam groove may be deformed by such hard abutment. Further, in order to assure a single action of the switch device, such a locking step must necessarily have a sufficient depth, and to this end, the rotational angle of the cam groove for releasing of a locked condition must be sufficiently great. Accordingly, a spacing for allowing rotation of the cam plate over a great angle is required, which obstructs miniaturization of the push button switch. However, if the cam plate does not have a sufficiently great rotational angle, a problem will give rise that a single action of the push button switch is not assured. Further, where the simultaneous locking preventing function is provided, the simultaneous locking preventing plate is required in addition to a push lock mechanism, and the push button switch is disadvantageous in miniaturization also in this regard.

SUMMARY OF THE INVENTION

Accordingly, it is an object of the present invention to provide a push button switch with a simultaneous locking preventing function which eliminates such problems of the prior art devices as described above and can attain its miniaturization while realizing a sure single action.

In order to attain the object, according to the present invention, there is provided a push button switch, comprising a casing, first and second sliders mounted for back and forth movement between a home position and a depressed position in the casing and each having a locking step thereon, a core mounted in each of the first and second sliders for sliding movement in a direction perpendicular to the direction of movement of the sliders and having a cam groove formed on a face of one end in the direction of movement thereof, an actuator pin provided for each of the first and second sliders for tracing the cam groove of a corresponding one of the cores and for cooperating with the locking step of the corresponding slider to lock the slider at the depressed position when the slider is moved from the home to the depressed position, and a simultaneous locking preventing member mounted for movement between the first and second sliders in the casing in a direction perpendicular to the direction of movement of the sliders and also to the direction of movement of the cores and having a pair of cam faces formed at opposite ends thereof, whereby, when one of the first and second sliders is moved from the home to the depressed position, the simultaneous locking preventing member is moved toward the other slider whereupon one of the cam faces thereof corresponding to the other slider engages with and pushes to move the corresponding core so that the corresponding actuator pin in its locked condition is released from the locking step of the other slider to allow the other slider to be moved from the depressed to the home position.

With the construction described above, if one of the sliders is depressed when the other slider is in its non-locked condition and remains at the home position, the actuator pin corresponding to the depressed slider traces the cam groove on the corresponding core and accordingly is locked with certainty at the depressed position by engagement of the actuator pin with the locking step on the depressed slider, thereby making a single action. To the contrary, of one of the sliders is depressed when the other slider is in its locked condition at the depressed position, the depressed slider itself is locked at the depressed position while at the same time it moves the core in the other slider by way of the simultaneous locking preventing member so that the actuator pin corresponding to the other slider is released from the locking step of the other slider to allow the other slider to be moved from the depressed to the home position, thereby making an interlocking action. On the other hand, in case the two sliders are depressed at the same time, the opposite ends of the simultaneous locking preventing member are abutted with the sliders to prevent the sliders from moving to the depressed positions, thereby making a simultaneous preventing action.

Therefore, according to the present invention, a push button switch there is provided with a simultaneous locking preventing function which has a minimized overall size and assures a single action.

The above and other objects, features and advantages of the present invention will become apparent from the following description and the appended claims, taken in conjunction with the accompanying drawings.

DETAILED DESCRIPTION OF THE PREFERRED EMBODIMENT

Figure 1:
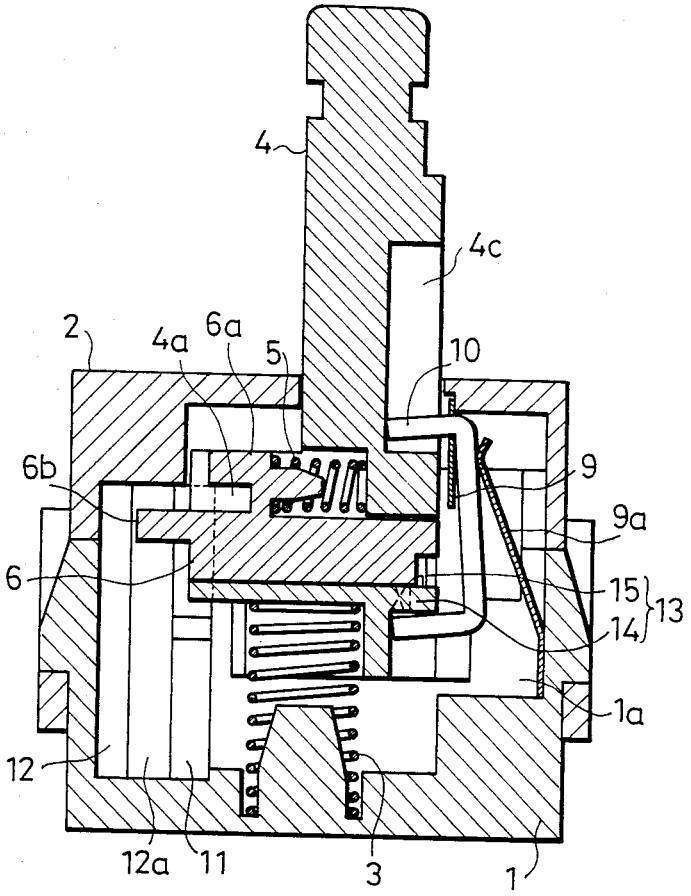
FIG. 1 is a vertical sectional view of a push button switch showing a preferred embodiment of the present invention.
Figure 2:
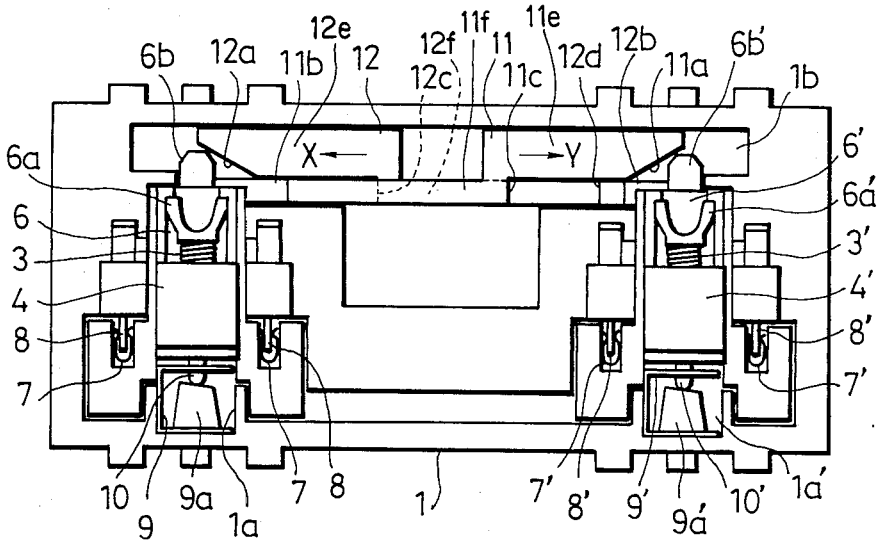
FIG. 2 is a plan view of the push button switch of FIG. 1 with an upper casing removed.
Figure 3:
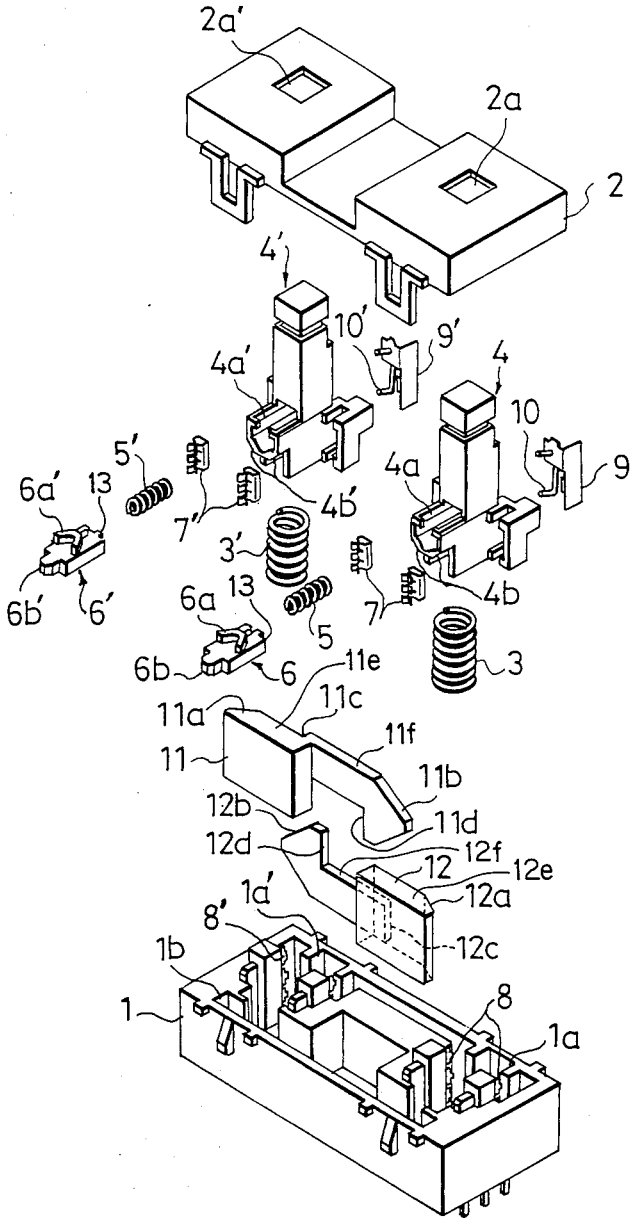
FIG. 3 is a fragmentary perspective view of the switch of FIG. 1.

Referring first to FIGS. 1 to 3, a push button switch of the present invention includes a lower casing 1 having an opening at the top thereof, and an upper casing 2 having two perforations 2*a* and 2*a'* formed in a top wall thereof. The lower and upper casings 1 and 2 are snap-coupled to form an outer housing of the push button switch. A pair of first and second switch units are installed in a predetermined spaced relationship within the outer casing consisting of the casings 1 and 2. Since the first and second switch units have a similar construction, description will be given below of the construction only of the first switch unit, and it is to be noted that corresponding elements of the second switch unit for which specific description is omitted are denoted by like reference numerals or symbols with a mark "'" annexed thereto.

In particular, the first switch unit includes a first slider 4 received for up and down movement between an upper home position and a lower depressed position in the lower casing 1 with a compression coil spring 3 interposed therebetween. An upper portion of the first slider 4 extends upwardly through and above the perforation 2*a* of the upper casing 2. The first slider 4 has formed at a lower portion thereof a sliding hole 4*a* which extends in a direction perpendicular to the direction of movement of the first slider 4, and an intermediately deformed V-shaped operating cam 4*b* is formed at a portion below one of a pair of openings of the sliding hole 4*a* of the first slider 4. A first core 6 is received for sliding movement in the sliding hole 4*a* of the first slider 4 with a compression coil spring 5 interposed therebetween and has a spring receiving portion 6*a* formed to project upwardly thereon. The spring receiving portion 6*a* of the first core 6 serves as a stopping member for preventing the first core 6 from being drawn off from the first slider 4. The first core 6 further has an operating projection 6*b* formed at one end in the direction of sliding movement thereof and has formed at the other end thereof part of a heart-shaped cam groove which will be hereinafter described.

Further, a pair of clip pieces 7 are mounted at a lower portion of the first slider 4 such that they extend across the sliding hole 4*a* of the first slider 4. The clip pieces 7 are designed to selectively hold therebetween one of a plurality of fixed terminals 8 provided in a juxtaposed relationship in the lower casing 1.

Meanwhile, a spring receiving spacing 1*a* is formed on an inner wall of the lower casing 1, and a leaf spring 9 in the form of a bent elastic plate is accommodated in the spring accommodating spacing 1*a*. A channel-shaped actuator pin 10 is supported at an upper portion thereof for pivotal motion on the leaf spring 9 and is urged to pivot in a direction toward the first slider 4 by a pressing piece 9*a* formed on the leaf spring 9. It is to be noted that the top end of the actuator pin 10 is positioned in a relief groove 4*c* formed on a side wall of the first slider 4 while the bottom end is held in engagement with the heart-shaped cam groove hereinafter described which is formed in a contiguous relationship to one end of the first core 6 at a lower portion of the side wall of the first slider 4.

The first switch unit has such a general construction as described above. As described hereinabove, the first switch unit and the second switch unit of the same construction are located in a predetermined spaced relationship within the lower casing 1. A communicating groove 1*b* for communicating the first and second switch units with each other is formed on the inside of a side wall of the lower casing 1, and first and second actuator plates 11 and 12 are received for sliding movement in the communicating groove 1*b*. Each of the actuator plate 11 and 12 presents such a configuration that a thin material portion 11*f* and 12*f* and a thick material portion 11*e* and 12*e* are connected to each other by way of an intermediate offset portion 11*c* or 12*c*, and the actuator plates 11 and 12 are combined so that the thick material portions 11*e* and 12*e* thereof are opposed to a face of the wall of the lower casing 1. The actuator plates 11 and 12 have first vertically extending inclined faces 11*a* and 12*a* formed at end portions 11*e* and 12*e* of the thick material portions thereof and second horizontally tapering inclined faces 11*b* and 12*b* and hook-shaped engaging portions 11*d* and 12*d* formed at end portions 11*f* and 12*f* of the thin material portions thereof. As apparently seen from FIG. 2, the first inclined face 11*a* of the first actuator plate 11 is opposed to the operating projection 6*a'* of the second core 6' and the second inclined face 11*b* is opposed to the operating cam 4*b* of the first slider 4 while the first inclined face 12*a* of the second actuator plate 12 is opposed to the operating portion 6*a* of the first core 6 and the second inclined face 12*b* is opposed to the operating cam 4*b'* of the second slider 4'.

Now, details of the heart-shaped cam groove mentioned above will be described with reference to FIGS. 4 and 5.

Figure 4:
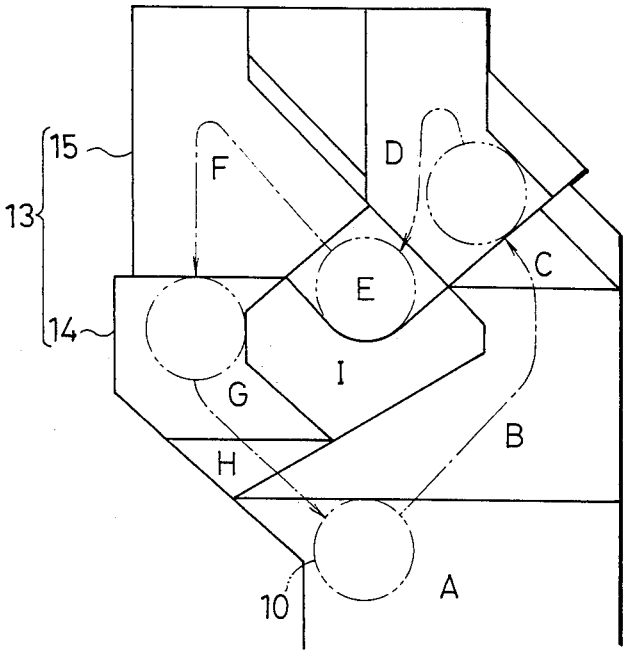
FIG. 4 is a plan view of a heart-shaped cam groove.
Figure 5:
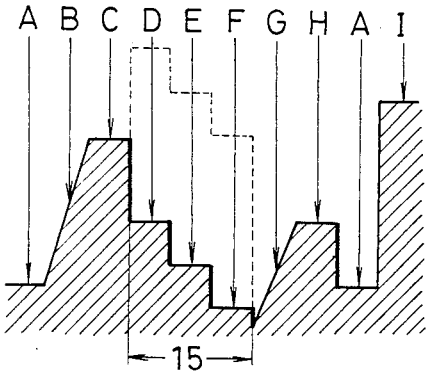
FIG. 5 is a diagrammatic representation illustrating different steps of the heart-shaped cam groove of FIG. 4.

As shown in FIG. 4, the heart-shaped cam groove 13 in the present embodiment includes up to 9 regions denoted from A to I wherein a first cam groove section 14 is constituted from the regions A, B, C, G, H and I and is formed at a lower portion of the side wall of each of the first and second sliders 4 and 4' while a second cam groove section 15 is constituted from the other regions D, E and F and is formed on an end face of each of the first and second cores 6 and 6'. If the core 6 or 6' is moved relative to the slider 4 or 4', this will cause variation of the height of the second cam groove section 15 relative to the first cam groove section 14, that is, the position of the first cam groove section 15 relative to the first cam section 14 in the horizontal direction in FIG. 1. However, when the core 6 or 6' is not actuated, the regions A to I thereof have such relations in height as illustrated in FIG. 5, and in this instance, the region I is located at the highest position. To the contrary, if the core 6 or 6' is actuated, then the first cam groove section 15 including the regions D, E and F is displaced or shifted as indicated in broken lines in FIG. 5 so that now the region E assumes a position higher than the region I.

Operation of the push button switch of the present embodiment having such a construction as described above will now be described.

If the first slider 4 is depressed against the compression coil spring 3 when the second slider 4' is not in its locked condition, the position of the actuator pin 10 relative to the heart-shaped cam groove 13 provided for the first slider 4 is changed so that the lower end of the actuator pin 10 traces the heart-shaped cam groove 15 while making a rocking motion around the fulcrum or support point thereof on the leaf spring 9. In particular, when the first slider 4 is in its normal non-depressed position, the actuator pin 10 engages with the region A of the first cam groove section 14 formed on the first slider 4 as indicated in two-dot chain lines in FIG. 4, and if the first slider 4 is depressed, the actuator pin 10 moves from the region A (presenting a flat surface) past the region B (presenting an upwardly inclined surface) and the region C (presenting a flat surface) all in the first cam groove section 14 and then the region D (presenting a flat surface) in the second cam groove section 15 formed on the first core 6 to the region E (presenting a flat surface). In this instance, since the region E is located at a lower height than (leftwardly, in FIG. 1, of) the region I (presenting a flat surface) below, the actuator pin 10 engages with the portion of the heart-shaped cam groove 15 at the position so that the first slider 4 is locked at its position. In the locked condition, if the first slider 4 is depressed a little, then the actuator pin 10 moves from the region E to the region F (presenting a flat surface), and then as the first slider 4 is subsequently moved up by the returning force of the spring 3, the actuator pin 10 moves past the region G (presenting an upwardly inclined surface) and the region H (presenting a flat surface) back to the region A. As the first slider 4 is reciprocated in this manner, the contacting relationship between the two clip pieces 7 and the fixed contacts 8 is varied to make switching of the push button switch. A single action of the first slider 4 proceeds in the manner described above.

On the contrary, if the second slider 4' is depressed when the first slider 4 is not in its locked condition, a single action of the second slider 4' is effected in a quite similar manner to that described above.

The foregoing description relates to a case wherein one of the two sliders 4 and 4' is not in its locked condition. To the contrary, if, for example, the second slider 4' is depressed when the first slider 4 is locked at its depressed position, the operating cam **4*b'* of the second slider 4' is abutted with the second inclined face 12*b* of the second actuator plate 12 to move the second actuator plate 12 in the direction indicated by an arrow mark X in FIG. 2. Consequently, the first inclined face 12*a* of the second actuator plate 12 is abutted with the operating projection 6*b* of the first core 6 so that the first core 6 is moved toward the actuator pin 10 against the urging force of the compression coil spring 5. As the first core 6 is actuated in this manner, the region E of the second cam groove section 15 formed on the first core 6 is projected farther than the region I of the first cam groove section 14 formed on the first slider 4 so that the actuator pin 10 which has been arrested by a step between the region I and the region E is released from the step. Consequently, the first slider 4 is released from the locked condition and thus returned upwardly by the spring 3. In this instance, since the second inclined face 11*b* of the first actuator plate 11 is at a position spaced from the operating cam 4*b* of the first slider 4, the second core 6' is not actuated by the first actuator plate 11. Meanwhile, the second slider 4'** is now locked at its depressed position.

On the contrary, if the first slider 4 is depressed when the second slider 4' is locked at its depressed position, the first actuator plate 11 is slidably moved in the direction indicated by an arrow mark Y in FIG. 2 due to abutment of the operating cam **4*b* of the first slider 4 with the second inclined face 11*b* of the first actuator plate 11 so that the second core 6' is actuated by the first inclined face 11*a* of the first actuator plate 11, thereby canceling the locked condition of the second slider 4'. Also in this instance, the first core 6 is not actuated by the second actuator plate 12 while the first slider 4** is locked at its depressed position. An interlocking operation proceeds in this manner.

To the contrary, if the first and second sliders 4 and 4' are depressed at the same time, the second inclined face **11*b* of the first actuator plate 11 is pushed by the operating cam 4*b* of the first slider 4 to move the first actuator plate 11 in the direction of the arrow mark Y in FIG. 2 while the second inclined face 12*b* of the second actuator plate 12 is pushed by the operating cam 4*b'* of the second slider 4' to move the second actuator plate 12 in the direction of the arrow mark X in FIG. 2 as described hereinabove. However, the first and second actuator plates 11 and 12 are allowed to move only by a predetermined restricted distance because the engaging portions 11*d* and 12*d* of the actuator plates 11 and 12 are soon abutted with the offset portions 12*c* and 11*c* of the other actuator plates 12 and 11, respectively. Accordingly, the sliders 4 and 4' are stopped from further movement by the actuator plates 11 and 12, or more particularly, forward movement of the sliders 4 and 4' is stopped before the respective actuator pins 10 and 10' are arrested by the locking steps of the heart-shaped cam grooves 13. Consequently, simultaneous locking of the sliders 4 and 4'** is prevented.

In the preferred embodiment described above, since locking and releasing of the actuator pins are done by the cores installed in the sliders, the locking steps of the heart-shaped cam grooves can be designed with a dimension sufficient to assure a stabilized single action of the push button switch. Further, since an interlocking action is made by actuating the core of one of the sliders in a locked condition by means of the other slider by way of one of the actuator plates, arrangement of the sliders can be designed freely by suitably changing the shape and size of the actuator plates.

Further, in the preferred embodiment described above, since simultaneous locking preventing members are constituted from the first and second actuator plates which are combined for movement relative to each other, the actuator plate corresponding to one of the sliders which remains not depressed can be held in a free condition during a single action. In other words, the degree of freedom in designing the four inclined faces required for the simultaneous locking preventing members can be improved.

It is to be noted that configuration of each of the heart-shaped cam grooves is not limited to that of the embodiment described above and may otherwise be such, for example, that the region E shown in FIG. 4 is formed on the core while the other regions are formed on the slider or that all the regions of the heart-shaped cam groove are formed on the core which is actuated in a direction to move away from the actuator pin by way of the first or second actuator plate.

Further, while the embodiment described above is described as the simultaneous locking preventing members are constituted from the first and second actuator plates, it is possible to unite the actuator plates in an integral relationship with each other.

Having now fully described the invention, it will be apparent to one of ordinary skill in the art that many changes and modifications can be made thereto without departing from the spirit and scope of the invention as set forth herein.

What is claimed is:

1. A push button switch, comprising a casing having contacts attached thereto, first and second sliders mounted for back and forth movement between a home position and a depressed position in said casing and each having contacts attached thereto, a first cam groove formed on a side of said slider, said cam groove being defined by a plurality of regions of heights varying in a direction perpendicular to the movement of said first and second sliders, a core mounted in each of said first and second sliders for sliding movement in a direction perpendicular to the direction of movement of said sliders and having a second cam groove formed on a face of one end of said core in the direction of movement thereof said second cam groove being defined by a plurality of regions of heights varying in a direction perpendicular to the movement of said first and second sliders, an actuator pin provided for each of said first and second sliders for traversing corresponding said first and second cam grooves and for locking the slider at the depressed position when the slider is moved from the home to the depressed position by contacting said second cam groove in a region of lowest height, thereby preventing further movement said actuator and said slider, and a simultaneous locking preventing member means mounted for movement between said first and second sliders in said casing in a direction perpendicular to the direction of movement of said sliders and also perpendicular to the direction of movement of said cores and having a pair of cam faces formed at opposite ends thereof, whereby, when one of said first and second sliders is moved from home to the depressed position, said simultaneous locking preventing member means is moved toward the other slider whereupon one of said cam faces thereof corresponding to the other slider engages with and pushes to move the corresponding core so that the corresponding actuator pin in it's locked condition is released from said region of lowest height of said second cam groove of the other slider to allow the other slider to be moved from the depressed to the home position.

2. A push button switch according to claim 1, wherein said simultaneous locking preventing member means is constituted from a pair of cooperating elements each having thereon one of said cam faces and an inclined face for cooperating with a corresponding one of said first and second sliders.

3. A push button switch according to claim 2, wherein each of said cooperating elements has a thick material portion on which said cam face is formed, a thin material portion on which said inclined face is formed, and an intermediate offset portion, and said elements are arranged such that said thick material portion of one of said elements is opposed to said thin material portion of the other of said elements.

4. A push button switch according to claim 3, wherein each of said cooperating elements has an engaging portion adjacent said inclined face thereof for engaging with said offset portion of the other of said elements to stop relative movement of said elements to prevent simultaneous movement of said first and second sliders from the home to the depressed positions.

5. A push button switch according to claim 1, wherein each of said first and second sliders has a cam groove formed on a side wall thereof in a continuous relationship to said cam groove of the corresponding core to form a unitary heart-shaped cam groove with said locking step of the slider located at the center of said heart-shaped cam groove.

6. In a push button switch which includes a casing having contacts attached thereto, a plurality of sliders mounted for back and forth movement in said casing and each of said slider having contacts attached thereto, and each of said slider having a first partial heart-shaped cam groove formed on a side wall thereof, an actuator pin for cooperating with the first partial heart-shaped cam groove of each of said sliders to lock the corresponding slides at its depressed position, a simultaneous locking prevention member means mounted for movement within a range of reciprocal movement of each two adjacent ones of said sliders and operable to prevent simultaneous locking of the adjacent sliders when the adjacent sliders are operable to prevent simultaneous locking of the adjacent sliders when the adjacent sliders are engaged with opposite ends of said simultaneous locking prevention member means, the improvement wherein each of said sliders has mounted thereon a core member which can slidably move in a direction perpendicular to the direction of reciprocal movement of the slider and which has a second partial heart-shaped cam groove formed on one end face thereof, said actuator pin cooperating with said second partial heart-shaped cam groove so that when a corresponding slider is actuated within said casing, said actuator pin traverses said first partial heart-shaped cam groove and engages a locking means located at the center of said second partial heart-shaped cam groove, said simultaneous locking prevention member means has formed at opposite ends thereof a pair of cam faces each for abutting with the other end of said core member to actuate said core member.

* * * * *

UNITED STATES PATENT AND TRADEMARK OFFICE

CERTIFICATE OF CORRECTION

PATENT NO. : 4,827,087

DATED : May 2, 1989

INVENTOR(S) : Akira Ninuma; Hidenori Nagai

It is certified that error appears in the above-identified patent and that said Letters Patent is hereby corrected as shown below:

On the title page, item [54] and column 1, line 2, the title should read --HEART-SHAPED LOCK CAM STRUCTURE OF PUSH SWITCH HAVING SINGLE ACTING AND COOPERATING MECHANISM--

Signed and Sealed this

Twenty-sixth Day of December, 1989

*Attest:*

JEFFREY M. SAMUELS

*Attesting Officer* *Acting Commissioner of Patents and Trademarks*